US005759761A

United States Patent [19]

Lushington et al.

[11] Patent Number: 5,759,761

[45] Date of Patent: Jun. 2, 1998

[54] GOLD CHEMICAL SENSITIZERS FOR SILVER HALIDES

[75] Inventors: Kenneth J. Lushington; Henry J. Gysling, both of Rochester, N.Y.

[73] Assignee: Eastman Kodak Company, Rochester, N.Y.

[21] Appl. No.: 868,652

[22] Filed: Jun. 4, 1997

[51] Int. Cl.[6] ..... G03C 1/09

[52] U.S. Cl. ..... 430/605; 430/569; 430/601; 430/603

[58] Field of Search ..... 430/569, 601, 430/603, 605

[56] References Cited

U.S. PATENT DOCUMENTS

| | | | |
|---|---|---|---|
| 2,642,361 | 6/1953 | Damschroder | 430/605 |
| 3,408,197 | 10/1968 | McVeigh | 430/605 |
| 3,442,653 | 5/1969 | Dunn | 430/605 |
| 5,049,484 | 9/1991 | Deaton | 430/605 |
| 5,049,485 | 9/1991 | Deaton | 430/605 |
| 5,169,751 | 12/1992 | Szues et al. | 430/605 |
| 5,220,030 | 6/1993 | Deaton | 548/105 |
| 5,252,455 | 10/1993 | Deaton | 430/605 |
| 5,391,727 | 2/1995 | Deaton | 540/1 |
| 5,620,841 | 4/1997 | Lok et al. | 430/600 |

OTHER PUBLICATIONS

Denko et al, Synthesis of Organic Compounds of Gold, Dec. 1945, p. 2241.

Akerstrom, Arkiv for Kemi Band 14 nr 35, May 1959, pp. 387–401.

Farrell et al, Inorganic Chemistry, vol. 10, No. 8, Feb. 1971, pp. 1606–1610.

Marcotrigiano et al, Inorg. Nucl. Chem. Letters, vol. 4, 1972, pp. 399–402.

Hesse et al, Acta Chemica Scandinavica, vol. 26, No. 10, 1972, pp. 3855–3864.

Lawton et al, Inorganic Chemistry, vol. 1, No. 9, 1972, pp. 2227–2233.

Bonati et al, Gazzetta Chimica Italiana, vol. 103, 1973, pp. 373–386.

Harbison et al, The Theory of the Photographic Process, Chapter 5, 1977, pp. 149–158.

Chiari et al, "Gold Dithiocarboxylates", Inorganic Chemistry, vol. 24, No. 3, 1985, pp. 366–371.

Miller et al, Synth. React. Inorg. Met.–Org. Chem., 15(2), 1985, pp. 223–233.

Schuerman et al, Jounral of the American Chemical Society, 1986, 108, pp. 336–337.

Siasios et al, Crystal Structure of Catena–bis–(diphenyl dithiophospinato)–digold(Au–Au), $C_{12}H_{10}AuPS_2$, 1995, p. 210.

Kawasaki et al, The Journal of Photographic Science, vol. 43, 1995, pp. 122–130.

Al–Sa'Ady et al, Inorganic Syntheses, vol. 23, A General Synthesis for Gold(I) Complexes, No. 39, pp. 191–193.

Uson et al, Inorganic Syntheses, vol. 26, (Tetrahydrothiophene)Gold(I) or Gold(III) Complexes, No. 17, pp. 85–86.

*Primary Examiner*—Hoa Van Le

*Attorney, Agent, or Firm*—Paul A. Leipold

[57] ABSTRACT

The invention is generally accomplished providing a silver halide emulsion comprising silver halide grains and a gold compound represented by Formula I:

$$\{AuS_2X\}_n$$

wherein

X is $PR_2$ (dithiophosphinates), $P(OR)_2$ (dithiophosphates), COR (xanthates), $CNR_2$ (dithiocarbamates), CR (dithiocarboxylates)

R is alkyl or aryl n=1–6.

14 Claims, No Drawings

GOLD CHEMICAL SENSITIZERS FOR SILVER HALIDES

FIELD OF THE INVENTION

The invention relates to compounds utilized in chemical sensitization of silver halide compounds. It particularly relates to gold compounds utilized in chemical sensitization of silver halides utilized in color negative, color reversal, and black and white films.

BACKGROUND OF THE INVENTION

Photographic silver halide materials are often chemically sensitized with one or more compounds containing labile atoms of gold, sulfur, selenium or tellurium, and the like to provide increased sensitivity to light and other sensitometric properties. Examples of typical chemically sensitized photographic silver halide emulsions are described in, for example, *Research Disclosure*, Item No. 308119, December 1989, Section III, and the references listed therein (Research Disclosure is published by Kenneth Mason Publications Ltd., Dudley Annex, 12a North Street, Emsworth, Hampshire PO 10 7DQ, England.) In *Research Disclosure*, Item No. 36544, September 1994, Section IV, page 510, there are a variety of chemical sensitizers disclosed.

The use of gold compounds as chemical sensitizers has been described in prior art patents.

Gold compounds used as chemical sensitizers have been reviewed by J. M. Harbison and H. E. Spencer (Chemical Sensitization and Environment Effects in The Theory of the Photographic Process, 4th Ed., Macmillan Publishing Co., Inc., N.Y., 1977, p. 149–160). Common prior art gold sensitizers include:

1) tetrachloroaurate(3+) salts: $M\{AuCl_4\}$ (M=H, Na, K). See R. E. Damschroder, U.S. Pat. No. 2,597,856 (1952; Eastman Kodak); K. Hasebe, U.S. Pat. No. 5,001,042 (1991; Fuji).

2) dithiocyanatoaurate(1+) salts: $M\{Au(SCN)_2\}$ (M=K, $NH_4$).

See U.S. Pat. No. 4,621,041 (1986; Misubishi); K. Hasebe, U.S. Pat. No. 5,001,042 (1991; Fuji); M. Kawasaki and Y. Oku, J. Photgr. Sci., 43, 122 (1995): Characterization of High-efficiency Hypersensitization of AgBr Emulsion by Gold(I) Thiocyanate Solution.

3) $Na_3\{Au(S_2O_3)_2\}\cdot 2H_2O$.

P. Faelens, R. Berendser, and B. H. Tavernier, Phot. Korr., 53, 75 (1966).

4) gold sulfide ($Au_2S$).

H. C. Yutzy and J. A. Leermakers, U.S. Pat. No. 2,597,915 (1952); R. E. Damschroder and H. C. Yutzy, U.S. Pat. No. 2,642,361 (1953; Eastman Kodak); H. Takiguchi, European Patent Application 0 454 069 A1 (1991; Konica); H. Masutomi, N. Uchida, H. Ohtani, and K. Ichikawa, U.S. Pat. No. 5,362,470 (1994).

5) gold(I) thiolates (i.e., AuS—X—$SO_3M$, wherein X is an aliphatic aromatic or heterocyclic bivalent radical, and M=H, an alkali or alkaline earth metal, or ammonium). Although the sulfonic acid salt substituent on the thiolate ligand imparts water solubility to such gold compounds, the process for preparing such Au(1+) compounds involves the use of gold fulminate, a compound that is very shock sensitive and, thus, not desirable for practical use.

B. H. Travernier and A. J. De Meyer, U.S. Pat. No. 3,503,749 (1970).

Gold(I) compounds with the formula $\{AuL_2\}^+X^-$ or $\{AuLL'\}^+X^-$ wherein L is a mesoionic compound, L' is a Lewis base, and X is an anion (e.g.,$BF_4(-)$ have also been described as gold sensitizers (see J. C. Deaton U.S. Pat. Nos. 5,049,485 (1992; Eastman Kodak) and 5,220,030 (1993; Eastman Kodak). A particularly preferred species is bis(1,4,5-trimethyl-1,2,4-triazolium-3-thiolate)- gold(I) tetrafluoroborate which has the structural formula:

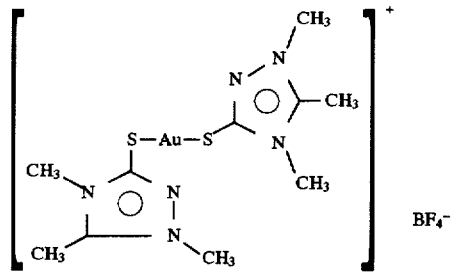

Another class of gold sensitizers, described in J. C. Deaton U.S. Pat. No. 5,049,484 (1991; Eastman Kodak) have the formula:

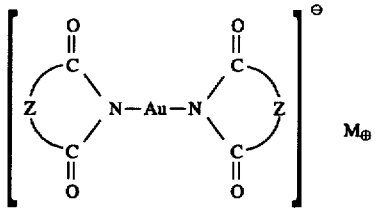

Gold(I) compounds having the formula $\{AuL\}^+X^-$ or $\{AuL\}_2^+2X^-$, where L is a macrocyclic compound containing at least two thioether and/or selenoether groups within a ring which comprises 12–30 atoms, and X is an anion (e.g., $BF_4(-)$) have also been described as gold sensitizers (J. C. Deaton, U.S. Pat. Nos. 5,252,455 (1993) and 5,391,727 (1995)).

PROBLEM TO BE SOLVED BY THE INVENTION

However, while the prior gold chemical sensitizers have been successful, there is a continuing need for chemical sensitizers that are more efficient and stable in providing improved sensitization to silver halide emulsions.

SUMMARY OF THE INVENTION

It is an object of the invention to provide improved chemical sensitizers for silver halide emulsions.

It is a further object of the invention to provide silver halide emulsions of greater sensitivity.

These and other objects of the invention generally are accomplished by a silver halide emulsion comprising silver halide grains and a gold compound represented by Formula I:

$$\{AuS_2X\}_n \qquad \text{I}$$

wherein

X is $PR_2$ (dithiophosphinates), $P(OR)_2$ (dithiophosphates), COR (xanthates), $CNR_2$ (dithiocarbamates), CR (dithiocarboxylates)

R is alkyl or aryl n=1–6.

ADVANTAGEOUS EFFECTS OF THE INVENTION

An advantage of the invention is highly sensitized silver halide emulsions. Another advantage of the invention is the providing of stable gold sensitizers.

The compounds of this invention can provide new gold sensitizers having excellent ambient stability allowing their synthesis and storage under normal conditions without any decomposition which could cause unwanted and uncontrolled sensitization effects.

The new chemical sensitizers of this invention can be purified by recrystallization to give crystalline solids of high purity which can be introduced into a silver halide emulsion in the finishing step as a solution in an appropriate solvent, e.g., water, methanol, ethanol, acetonitrile, N,N-dimethylformamide, etc.

DETAILED DESCRIPTION OF THE INVENTION

The invention gold sensitizers have not been previously utilized as chemical sensitizers. The gold compounds of the invention have numerous advantages over prior materials. The Au(I) coordination complexes of this invention give high sensitization compared to prior art gold sensitizers. The Au(I) coordination complexes of this invention exhibit enhanced stability as solutions under ambient keeping conditions compared to prior art gold sensitizers. The Au(I) coordination complexes of this invention can be prepared in high yields by convenient synthetic procedures.

The new chemical sensitizers of this invention can be purified by recrystallization to give crystalline solids of high purity which can be introduced into a silver halide emulsion in the finishing step as a methanol solution.

The gold compounds are generally formed, for example, by the techniques disclosed in J. B. Miller and J. L. Burmeister, Synth. React. Inorg. Met.-Org. Chem., 15, 223 (1985).

Any gold compound as set forth in Formula I is a suitable sensitizer. The preferred sensitizer has been found to be $\{AuS_2P(i\text{-}Bu)_2\}_2$.

The gold(I) compounds of this invention can be prepared by reaction of an alkali metal salt of the appropriate 1,1-dithio anionic ligand with either a Au(3+) salt, e.g., $C\{AuCl_4\}$ (C=H, Na, K, $NH_4$) or a Au(I)salt, e.g., $C\{AuCl_2\}$. In the former case excess ligand is needed in the reaction since it must function both as a reducing agent for the Au(3+)->Au(1+) reduction, as well as a ligand for the final Au(1+).

Since simple Au(I) salts are unstable with respect to decomposition by a disproportionation reaction, suitable Au(I) starting materials must be stabilized to allow their use in the preparative procedure for the compounds of this invention. The useful Au(I) starting materials can be Au(I) compounds sufficiently stabilized by ligands to allow their isolation as stable solids. Such complexes include AuCIL ($L=Me_2S$: F. Bonati and G. Minghetti, Gazz. Chim. Ital., 103, 373(1973); tetrahydrothiophene: R. Uson, A. Laguna, and M. Laguna, Inorg. Synth., 26 85(1989); 2,2'-thiodiethanol (thiodiglycol): A. K. Al-Sa'ady, C. A. McAuliffe, R. V. Parish, and J. A. Sandbank, Inorg. Synth., 23, 191(1985)), and $\{AuL_2\}BF_4$ (L=thiourea: G. Marcotrigiano, R. Battistuzzi, and G. Peyronel, Inorg. Nucl. Chem. Lett., 8, 399(1972); L=pentamethylenesulfide: D. T. Hill, U.S. Pat. No. 4,165,380(1979)). The stabilizing organic ligands incorporated in such starting materials must be sufficiently good ligands to allow the isolation of solid Au(I)compounds that have reasonable stability but must not be too tightly coordinated to the Au(I) to prevent their facile displacement from the Au(I) coordination sphere upon reaction with the 1,1-dithio anionic ligands of this invention to produce the desired $AuS_2X$.

Alternatively, metastable Au(1+) complexes can be generated in-situ from Au(3+) salts by suitable reducing agents, generally at low temperatures and in the presence of excess stabilizing ligand to allow the formation of labile Au(1+) intermediates which can be reacted soon after their formation in solution with the 1,1,-dithio anionic ligands without actual isolation of a Au(1+) reagent. A useful synthetic procedure of the latter type is the in-situ formation of the metastable Au(1+) complex, $\{AuCl_2\}(1-)$, by the sodium sulfite reduction of a Au(3+)chloro complex, $C\{AuCl_4\}$ ($C=NH_4$, Na, K) in a saturated aqueous sodium chloride at low temperature (e.g., ca. 0°—10° C.), followed by reaction of this metastable $\{AuCl_2\}(1-)$ with a water soluble salt of a 1,1-dithio type anion (see H. J. A. Blaauw, R. J. F. Nivard, and G. J. M. van der Kerk, J. Organometal. Chem., 2, 236(1964) and J. B. Miller and J. L. Burmeister,Synth. React. Inorg. Met.-Org. Chem., 15, 223(1985): The Synthesis of Dialkyldithiocarbamatogold(I) Dimers). The in-situ reduction of the Au(3+) complex, $\{AuCl_4\}(1-)$, to the Au(1+) complex, $\{AuCl_2\}(-1)$ is accompanied by a color change from bright yellow to colorless. When the completion of the in-situ reduction is evidenced by the complete decolorization of the initial $C\{AuCl_4\}$ solution, an aqueous solution of the appropriate 1,1-dithio type anion is immediately added to form the desired $AuS_2X$ compound. The resulting $AuS_2X$ product, in some cases, may precipitate from the solution allowing its isolation by filtration and purification by washing well with water (and in some cases followed by ethanol and ethyl ether) and subsequent drying and recrystallization from an appropriate solvent. In other cases the desired product can be isolated by extraction of the aqueous reaction solution with an immiscible organic solvent such as toluene, methylene chloride, etc., followed by drying of the resulting non-aqueous solution of the desired product and isolation of the solid $AuS_2X$ product by concentration of the solution volume. The resulting isolated $AuS_2X$ product can then be further purified by recrystallization from an appropriate organic solvent.

Although the formula of complexes of this invention can be written as $\{AuS_2X\}$, the actual structure may be dimeric, trimeric, or higher in degree of association. A single crystal X-ray diffraction studies of the Au(I) complex of the nominal formula $AuS_2P(i\text{-}Bu)_2$, prepared in this work, for example, has shown that this complex is dimeric with two di(iso-butyl)dithiophosphinate ligands bridging a pair of Au(1+)ions, with each gold having linear two-coordination. The intramolecular Au-Au distance in the 8-membered Au-$\{S\text{-}P\text{-}S\}_2$-Au ring of this compound is 3.17 A, and there are no significant intermolecular interactions between the dimers.

Examples of gold(I) compounds with 1,1-dithio type anionic ligands, in addition to the new composition, $\{AuS_2P(i\text{-}C_4H_9)_2\}_2$, of this invention have been previously described in the literature, and these compounds are also useful within the scope of this invention as gold sensitizers:

$AuS_2X$ I

1) $AuS_2CNR_2$ - gold(I) dithiocarbamates

R=methyl, ethyl, n-propyl, iso-propyl, n-butyl, iso-butyl, n-amyl, iso-amyl

S. Akerstrom, Arkiv for Kemi, 14, 387(1959): The N,N-Dialkyldithiocarbamates of the Univalent Coinage Metals R. Hesse and P. Jennische, Acta Chem. Scand., 26, 3855(1972): The Crystal and Molecular Structure of the Gold(I) Dipropyldithiocarbamate Dimer.

F. J. Farrell and T. G. Spiro, Inorg. Chem., 10, 1606 (1971): Raman Study of Metal-Meal Bonding in Gold(I) Diisobutyldithiocarbamate.

J. B. Miller and J. L. Burmeister, Synth. React. Inorg. Met.-Org. Chem., 15, 223(1985): The Synthesis of Dialkyldithiocarbamatogold(I) Dimers.

$R=n-C_9H_{19}$

H. J. A. Blaauw, R. J. F. Nivard, and G. J. M. van der Kerk, J. Organometal. Chem., 2, 236(1964): Chemistry of Organogold Compounds 1. Syntheses and Properties of Dihalogold(III) N,N-Dialkyldithiocarbamates and Dialkylgold(III) N,N-Dialkyldithiocarbamates.

R=i-butyl, n-octyl, n-dodecyl, cyclohexyl, benzyl, allyl, $R_2$=morpholino, piperidino J. B. Miller and J. L. Burmeister, Synth. React. Inorg. Met.-Org. Chem., 15, 223(1985): The Synthesis of Dialkyldithiocarbamatogold (I) Dimers.

2) $AuS_2P(OR)_2$ - gold(I) dithiophosphates

R=iso-propyl, neopentyl,

J. J. Dickert and C. N. Rowe, U.S. Pat. No. 3,554,908 (1971; Mobil Oil Corp.): Phosphorodithioate Salts as Antiwear Agents.

S. J. Lawton, W. J. Rohrbaugh, and G. T. Kokotailo, Inorg. Chem., 11, 2227 (1972): The Crystal structure of catena-Bis{μ-(O,O'-di-isopropyldithiophosphato)digold(I)} (Au-Au), $\{\{Au(i\text{-}C_3H_7O)_2PS_2\}_2\}_n$, a Polymeric Complex Containing Weak Gold-Gold Interactions.

3) $AuS_2PR_2$ - gold(I) dithiophosphinates $R=C_2H_5$, $n\text{-}C_3H_7$

W. Kuchen and H. Mayatepek, Chem. Ber., 101, 3454 (1968): Dithiophosphinate Complexes of Copper, Silver, Gold, and Thallium.

R=Ph

G. Siasios and E. R. T. Tiekink, Zeit. Kristallogr., 210, 698(1995): Crystal Structure of catena-{μ-(diphenyldithiophosphinato)digold} (Au-Au), $C_{12}H_{10}AuPS_2$.

4) $AuS_2COR$ - gold(I) xanthates $R=CH_3$, $C_2H_5$, $n\text{-}C_3H_7$, $i\text{-}C_3H_7$, $n\text{-}C_4H_9$, $i\text{-}C_4H_9$ C. W. Denko and A. K. Anderson, J. Amer. Chem. Soc., 67, 2241 (1945): The Synthesis of Some Organic Compounds of Gold.

5) $AuS_2CR$ - gold(I) dithiocarboxylates $R=CH_3$, $C_6H_5$

B. Chiari, O. Piovesana, T. Tarantelli, and P. F. Zanazzi, Inorg. Chem., 24, 366 (1985): Gold Dithiocarboxylates.

$R=o\text{-}CH_3—C_6H_4$

J. A. Schuerman, F. R. Fronczek, and J. Selbin, J. Amer. Chem. Soc., 108, 336 (1986): Synthesis and Structure of $\{Au_6(o\text{-}CH_3C_6H_4CS_2)_6\}$, a Novel Gold Cluster Compound.

While the formation of the Au(I) compounds of this invention has been described in the literature, there has been no description of the use of these Au(I) complexes with 1,1-dithio type ligands (e.g., FORMULA I above) as chemical sensitizers for silver halide emulsions (nor for any emulsion addenda application).

Typical compounds of the Formula I suitable for the invention are listed in Table 1 below.

TABLE 1

EXAMPLES OF Au(I) COORDINATION COMPLEXES TYPICAL OF THE GENERAL FORMULA $\{AuS_2X\}_n$

1) $\{AuS_2P(i\text{-}Bu)_2\}_2$
2) $\{AuS_2PEt_2\}_2$
3) $\{AuS_2PPh_2\}_2$
4) $\{AuS_2P(C_6F_5)_2\}_2$
5) $\{AuS_2P(OMe)_2\}_2$
6) $\{AuS_2P(OEt)_2\}_2$
7) $\{AuS_2P(O\text{-}iPr)_2\}_2$
8) $\{AuS_2P(OPh)_2\}_2$
9) $\{AuS_2CO\text{-}i\text{-}Bu\}_2$
10) $\{AuS_2CO\text{-}n\text{-}C_5H_{11}\}_2$
11) $\{AuS_2COCH_2CH_2OMe\}_2$
12) $\{AuS_2COCH_2CH_2CH_2S\text{-}n\text{-}C_3H_7\}_2$
13) $\{AuS_2CNEt_2\}_2$
14) $\{AuS_2CN(n\text{-}Bu)_2\}_2$
15) $\{AuS_2CN(n\text{-}C_8H_{17})_2\}_2$
16) $\{AuS_2CN(CH_2CH_2OH)_2\}_2$
17) $\{AuS_2CMe\}_2$
18) $\{AuS_2C\text{-}o\text{-}CH_3C_6H_4\}_6$ The gold complexes of the invention may be utilized in any suitable amount. Typically the gold compounds would be utilized in an amount between about 0.01 and 100 μmol/mol Ag. Preferably they would be utilized in an amount between about 0.1 and 50 μmol/mol Ag for best sensitization.

The gold complexes of the invention may be added to a silver halide emulsion at various stages during emulsion preparation and finishing. The gold compounds may be added during emulsion formation, or they may be added after emulsion formation and after washing of the emulsion. They may be added prior to a heat cycle for chemical sensitization or they may be added during the heat cycle after the emulsion has been brought to an increased temperature. It is preferred that they be added either prior to or during the sensitization cycle. The heat cycle is preferably carried out at a temperature of between about 30 and 90° C. with a preferred temperature of addition being between 40° and 70° C. The addition may take place prior to heating or after heating has taken place. The gold sensitizing compounds may be added singly or in combination with other sensitizing agents. They also may be added to a silver halide emulsion along with silver ion ligands and silver halide growth modifiers or stabilizers and the antifogging agents. Further, the gold complexes of the invention may be added with other chemical sensitizing agents such as sulfur, selenium or tellurium, or other noble metal compounds such as those of palladium, platinum, rhodium, or iridium compounds or with dopants such as iron, iridium, rhodium, ruthenium, or osmium complexes. The gold sensitizers may be added during formation of silver halide grains, during the physical or chemical ripening stage, or in a separate step immediately prior to coating to form a photographic element. The gold sensitizers may be added in the presence of spectral sensitizing dyes and other organic addenda.

This invention provides a process for chemical sensitizing a silver halide emulsion formed according to any of the processes generally well known in the art. A double jet-type process is preferred. The silver halide grains can comprise mixed or single halide components and especially include chloride, bromide, iodide, iodochloride, iodobromide or chlorobromide grains. They can also be different morphologies such as cubic, tabular core shell or tetradecahedral.

The double-jet process comprises adding an aqueous silver nitrate solution and an aqueous solution of one or more halides, for example, an alkali metal halide such as potassium bromide, potassium chloride, potassium iodide or mixtures thereof, simultaneously to a stirred solution of a silver halide protective colloid through two separate jets.

Gelatin is preferred as the binder or protective colloid for the photographic emulsion of the present invention. However, other hydrophilic colloids are also suitable. For example, proteins such as gelatin derivatives, graft polymers of gelatin and other polymers, albumin, casein, cellulose derivatives such as hydroxyethyl cellulose, carboxymethyl cellulose and cellulose sulfate, sugar derivatives such as sodium alginate, starch derivatives and various synthetic peptizers such as hydrophilic homopolymers or copolymers such as polyvinyl alcohol, poly-N-vinylpyrrolidone, polyacrylic acid, polymethacrylic acid, polyacrylamide, polyvinylimidazole and polyvinyl pyrazole can be used.

Acid-processed gelatin can be used, as well as lime-processed gelatin. Further, gelatin hydrolyzates and enzyme-hydrolyzed products of gelatin are also usable.

Surface-active agents may be incorporated in a photographic emulsion layer or in another hydrophilic colloid layer as a coating aid to prevent buildup of static charge, to improve lubrication properties, to improve emulsion dispersion, to prevent adhesion and to improve other properties.

A photosensitive material of the present invention may contain antifogging agents or emulsion-stabilizing agents such as, for example, azaindenes, disulfides, thionamides, azoles and the like.

The photographic silver halide emulsions as described can be used in photographic silver halide elements in any of the ways and for purposes known in the photographic art.

The photographic silver halide emulsions can be used and incorporated in photographic elements that are black and white, single color elements or multicolor elements. Multicolor elements contain dye image-forming units sensitive to each of the three primary regions of the visible spectrum. Each unit can be comprised of a single emulsion layer or of multiple emulsion layers sensitive to given regions of the spectrum. The layers of the element can be arranged in various orders as known in the art.

In the following discussion of suitable materials for use in emulsions and elements of the invention, reference will be made to *Research Disclosure*, Number 36544 of September 1994. *Research Disclosure* is published by Kenneth Masons Publications Ltd., Dudley House, 12A North Street, Emsworth, Hampshire PO 10 7DQ, England. This publication will be identified hereafter by the term "Research Disclosure".

The silver halide emulsions of the invention can be used in elements that can be either negative-working or positive-working. The emulsions in which the described new chemical sensitizers can be used are described in, for example, *Research Disclosure* Sections I, II and III and the publications and patents cited therein. Useful vehicles for the emulsion layers and other layers of elements of the invention are described in *Research Disclosure* Section IX and the publications cited therein.

The described photographic emulsions can be used in color photographic elements with couplers as described in *Research Disclosure* Section X and the publications cited therein. The couplers can be incorporated in the elements and emulsions as described in *Research Disclosure* Section XI and ways known in the art.

The photographic elements and emulsions as described can contain addenda known to be useful in photographic elements and emulsions in the photographic art. The photographic elements and emulsions as described can contain, for example, brighteners (see *Research Disclosure* Section VI); antifoggants and stabilizers (see *Research Disclosure* Section VII); antistain agents and image dye stabilizers (see *Research Disclosure* Section X); light absorbing and scattering materials (see *Research Disclosure* Section II); hardeners (see *Research Disclosure* Section IX); coating aids (see *Research Disclosure* Section IX); plasticizers and lubricants (see *Research Disclosure* Section IX); antistatic agents (see *Research Disclosure* Section IX); matting agents (see *Research Disclosure* Section IX); and development modifiers (see *Research Disclosure* Section XVIII).

The photographic silver halide materials and elements as described can be coated on a variety of supports as described in *Research Disclosure* Section XV and the publications cited therein.

The photographic silver halide materials and elements as described can include coarse, regular and fine grain silver halide crystals or mixtures thereof and can be comprised of any photographic silver halides known in the photographic art.

The photographic silver halide materials as described can be spectrally sensitized by means and dyes known in the photographic art, such as by means of spectral sensitizing dyes as described in, for example, *Research Disclosure* Section V and the publications cited therein. Combinations of spectral sensitizing dyes are especially useful.

Photographic materials and elements as described can be exposed to actinic radiation, typically in the visible region of the spectrum, to form a latent image as described in *Research Disclosure* Section XVI and then processed to form a visible image as described in, for example, *Research Disclosure* Section XVIII using developing agents and other processing agents known in the photographic art. Processing to form a visible image, typically a dye image, includes the step of contacting the element with a developing agent, typically a color developing agent, to reduce developable silver halide and oxidize the developing agent. In a color material the oxidized color developing agent in turn reacts with couplers to yield a dye.

The photographic silver halide materials can also be used in physical development systems as described in *Research Disclosure* Section XVII, in image-transfer systems as described in *Research Disclosure* Section X, in dry development systems as described in *Research Disclosure* Section XVII and in printing and lithography materials as described in *Research Disclosure* Section XIX.

The photosensitive materials obtained by the present invention can be processed according to known methods. A developer to be used for the black-and-white processing can contain conventional developing agents such as dihydroxybenzenes (e.g., hydroquinone), 3-pyrazolidones (e.g., 1-phenyl-3-pyrazolidone), amino-phenols (e.g., N-methyl-p-amino-phenol), 1-phenyl-3-pyrazolidones or ascorbic acids.

As color-developing agent, there can be used primary aromatic amine developing agents such as phenylenediamines (e.g., 4-amino-N,N-diethylaniline, 3-methyl-4-amino-N,N-diethylaniline, 4-amino-3-methyl-N-hydroxyethylaniline, 3-methyl-4-amino-N-ethyl-N-hydroxyethylaniline, 3-methyl-4-amino-N-ethyl-N-methanesulfonamido-ethylaniline and 4-amino-3-methyl-N-ethyl-N-methoxyethylaniline. In addition, the developing agents described in L. F. A. Mason, *Photographic Processing Chemistry* (Focal Press, 1966), pp. 226–229, as well as those described in U.S. Pat. Nos. 2,193,015 and 2,592,364 may be used.

A photographic emulsion useful in the present invention can be applied to many different silver halide photographic light-sensitive materials due to its high photographic sensitivity, contrast, and fog reduction. For example, it can be used in high speed black-and-white negative films, in X-ray films and in multilayer color negative films. Addenda such as antifoggants and spectral sensitizers may be present during chemical sensitization with the invention materials.

The invention is particularly suitable for use with tabular silver bromoiodide grains which find their preferred use in color negative films. In such films it is particularly important that higher speeds be obtained, as there is a continuing need for higher speed films for color negative photography.

The following examples illustrate the practice of this invention. They are not intended to be exhaustive of all possible variations of the invention. Parts and percentages are by weight unless otherwise indicated.

SYNTHETIC METHODS FOR PREPARATION OF Au(I) COMPLEXES OF THIS INVENTION

The general synthetic routes which can be used to prepare the complexes of this invention are known in the prior art.

EXAMPLES

EXAMPLE 1

SYNTHESIS OF $\{AuS_2P\{i\text{-}Bu)_2\}_2$

A solution of $K\{AuCl_4\}$ (1.13 g, 3 mmoles) in 25 ml of water was added to an aqueous solution of $NaS_2P(i\text{-}Bu)_2$ (5 ml of a 50% aqueous solution of AEROPHINE 3418A (available from Cytec Industries, Inc.) which was diluted to 70 ml with water). The resulting solution was stirred for 2 hours at room temperature and then concentrated to dryness under vacuum to give a gummy white solid. This white solid was extracted with methylene chloride (3×250 ml portions) and the combined extracts were washed with water (2×250 ml portions), dried over $MgSO_4$ and filtered, and the resulting pale yellow solution was concentrated under vacuum to give a yellow oil. Addition of 50 ml of ether to this oil, followed by cooling overnight at −20° C. gave a crop of white solid (0.9 g). The white solid was isolated by filtration and recrystallized from 100 ml of hot methanol to give a crop of white crystals (0.6 g (50% yield): Calcd. (found) for $C_8H_{18}AuPS_2$ (MW=406.30): C, 23.65 (24.02); H, 4.47 (4.60); S, 15.78 (16.31); m.p. 120° C. (DSC)). Thermal gravimetric analysis (TGA) of this compound, under a nitrogen atmosphere, showed a clean thermal decomposition of the compound in the temperature range 200°–275° C. to give a residue corresponding to elemental gold (i.e.,% residue at 300° C.=48.2 (theoretical % Au in the compound= 48.48%).

EXAMPLE 2

AN ALTERNATE SYNTHESIS OF $\{AuS_2P(i\text{-}C_4H_9)_2\}_2$ $K\{AuCl_4\}$ (3.8 g, 10 mmoles) was dissolved in 200 ml of a saturated aqueous NaCl solution (ca. 70 g NaCl/200 ml $H_2O$). The resulting solution was cooled to −10° C. and to it was added a solution of 1.64 g (13 mmoles) of $Na_2SO_3$ dissolved in 140 ml of water. The initial bright yellow solution became colorless in ca 30 seconds and 10 ml of a 2.2 M aqueous solution of $NaS_2P(i\text{-}Bu)_2$ (Aerophine-3418A, available from Cytec Industries, Inc.) was immediately added. The solution was stirred for 30 minutes and the product was extracted with 3–300 ml portions of methylene chloride. The combined $CH_2Cl_2$ extracts were washed with 2–200 ml portions of water, and the resulting yellow-green $CH_2Cl_2$ solution was then dried over $MgSO_4$ and the solvent was removed on a rotary evaporator to give a pale green oil. Dissolution of this oil in 250 ml of ether and cooling of the resulting solution to −78° C. gave a white precipitate which was filtered, washed with ether, and vacuum dried to give 2.0 g of a white powder. Recrystallization of this product from 400 ml of hot methanol gave 1.8 g. of a white crystalline product (44%: Calcd. (found) for $C_8H_{18}AuPS_2$ (MW=406.30): C, 23.65 (23.61); H, 4.47 (4.25); S, 15.78 (15.79); m.p. 120° C. (DSC). Since the field desorption mass spectrum of this compound showed mass peaks corresponding to the monomer (406), the dimer (812), and the tetramer (1624), the structure of this compound was determined by single crystal X-ray diffraction which established it to be dimeric with bridging dithiophosphinate ligands and essentially linear, two-coordinate gold(I).

EXAMPLE 3

SYNTHESIS OF $AuS_2P(OEt)_2$

This complex was prepared by the general procedure described in Example 3 (using 10 mmoles of $K\{AuCl_4\}$ and 15 mmoles (3.05 g) of $NH_4\{S_2P(OEt)_2\}$). The initial pale gray product (3.5 g) was recrystallized from 600 ml of hot methanol to give, after cooling overnight at −20° C., a crop of white needles (2.8 g; Calcd. (Found) for $C_4H_{10}AuO_2PS_2$: C, 12.57 (12.59); H, 2.64 (2.47); S, 16.78 (16.74).

EXAMPLE 4

SENSITIZATION OF A RUN-DUMP TABULAR EMULSION WITH THE GOLD COMPLEXES OF THIS INVENTIONS

A tabular silver bromoiodide emulsion (Emulsion 1) with a 1.4 μm equivalent circular diameter and a thickness of 0.12 μm and a 1.5% I run and 3% I dump was prepared as taught in B. R. Johnson and P. J. Wrightman, U.S. Pat. No. 5,164,292 (1992). This emulsion was then treated with either a gold-only sensitization where the gold complexes were added at a variety of levels at a temperature of 40° C. or the emulsion was treated with a sulfur-gold sensitization where 10 μmoles of sodium thiosulfate-pentahydrate was first added at a temperature of 40° C., held for 5 minutes followed then by the addition of one of the gold complexes (Table 2). The emulsion melt temperature was then linearly ramped at 1.33° C./min. to 65° C. and held for 20 minutes. Once the chemical digestion was complete, the example emulsions were cooled and coated on a film support at 1614 mg Ag m(−2) and 3230 mg gel m(−2). A 1614 mg gel m(−2) overcoat was applied over the emulsion containing layers. The coatings were then dried and exposed (0.1 s,365 nm source) through a graduated density step wedge, processed (6 minutes at 20° C.) in KODAK Rapid X-ray Developer, washed, and dried. Speeds are expressed as the relative exposure required to increase the measured density to 0.15 above fog.

TABLE 2

Sensitometric Results For AgBrI Run-Dump Tabular Emulsion Sensitized With Compounds of this Invention

| Au(I) Compound | Emulsion | Au(I) Solvent | Thiosulfate Level (μ mole) | Au(I) Level (μ mole) | $D_{min}$ | Relative Speed |
|---|---|---|---|---|---|---|
| Check 1 | Emulsion 1 | — | 0 | 0 | 0.04 | 100 |
| Check 2 | Emulsion 1 | — | 10 | 0 | 0.046 | 1514 |
| AuTT(a) | Emulsion 1 | $H_2O$ | 0 | 10 | 0.065 | 338 |
| AuTT(a) | Emulsion 1 | $H_2O$ | 0 | 25 | 0.106 | 1000 |
| AuTT(a) | Emulsion 1 | $H_2O$ | 0 | 40 | 0.131 | 1698 |
| AuTT(a) | Emulsion 1 | $H_2O$ | 10 | 10 | 0.145 | 5128 |
| $\{AuS_2P(i\text{-}Bu)_2\}_2$ | Emulsion 1 | MeOH | 0 | 10 | 0.073 | 525 |
| $\{AuS_2P(i\text{-}Bu)_2\}_2$ | Emulsion 1 | MeOH | 0 | 25 | 0.148 | 3235 |
| $\{AuS_2P(i\text{-}Bu)_2\}_2$ | Emulsion 1 | MeOH | 0 | 40 | 0.241 | 4466 |
| $\{AuS_2P(i\text{-}Bu)_2\}_2$ | Emulsion 1 | MeOH | 10 | 10 | 0.122 | 4786 |

(a)AuTT = bis(1,4,5-trimethyl-1,2,4-triazolium-3-thiolato)gold(I) tetrafluoroborate (described in J. C. Deaton, U.S. Pat. No. 5,220,030 - 1993)

EXAMPLE 5

SENSITIZATION OF MONODISPERSE AgBr TABULAR EMULSIONS

A tabular monodisperse silver bromide emulsion (Emulsion 2) with an equivalent circular diameter of 2.4 μm and a thickness of 0.138 μm, was treated with methanol solutions of $\{AuS_2P(OEt)_2\}_2$ and $\{AuS_2P(i\text{-}Bu)_2\}_2$ at the levels given in Table 3. The emulsion was then treated with either a gold-only sensitization where the gold complexes were added at a variety of levels at a temperature of 40° C. or the emulsion was treated with a sulfur-gold sensitization where 10 μmoles of sodium thiosulfate-pentahydrate was first added at a temperature of 40° C., held for 5 minutes followed then by the addition of one of the gold complexes. The emulsion melt tempeature was then linearly ramped at 1.33C/min to 65° C. and held for 20 minutes. Once the chemical digestion was complete, the example emulsions were cooled and coated on a film support at 1618 mg Ag $m^{-2}$ and 3230 mg gel $m^{-2}$. A 1614 mg gel $m^{-2}$ overcoat was applied over the emulsion containing layer. The coating was then dried and exposed (0.1 s, 365 nm source) through a graduated density step wedge, processed (6 minutes at 20° C.) in KODAK Rapid X-ray Developer, washed, and dried. This sensitometric results for these films are given in Table 3.

TABLE 3

Sensitometric Results For Monodisperse AgBr Tabular Emulsion With $AuS_2P(OEt)_2$

| Au(I) Compound | Emulsion | Au(I) Solvent | Thiosulfate Level (μ mole) | Au(I) Level (μ mole) | $D_{min}$ | Relative Speed |
|---|---|---|---|---|---|---|
| Check 1 | Emulsion 2 | — | 0 | 0 | 0.04 | 100 |
| Check 2 | Emulsion 2 | — | 10 | 0 | 0.046 | 1514 |
| $\{AuS_2P(i\text{-}Bu)_2\}_2$ | Emulsion 2 | MeOH | 10 | 10 | 0.262 | 3548 |
| $\{AuS_2P(OC_2H_5)_2\}_2$ | Emulsion 2 | MeOH | 0 | 25 | 0.1100 | 1698 |
| $\{AuS_2P(OC_2H_5)_2\}_2$ | Emulsion 2 | MeOH | 0 | 40 | 0.104 | 1513 |
| $\{AuS_2P(OC_2H_5)_2\}_2$ | Emulsion 2 | MeOH | 10 | 10 | 0.248 | 3715 |

The invention has been described in detail with particular reference to preferred embodiments thereof, but it will be understood that variations and modifications can be effected within the spirit and scope of the invention.

We claim:

1. A silver halide emulsion comprising silver halide grains and at least one gold compound represented by Formula I:

$$\{AuS_2X\}_n$$

wherein

X is $PR_2$, $P(OR)_2$, COR, $CNR_2$, CR

R is alkyl or aryl n=1–6.

2. The emulsion of claim 1 wherein said gold compound is located on the surface of said grain.

3. The emulsion of claim 1 wherein said gold compound is present in an amount between 0.01 and 100 μmol/mol Ag.

4. The emulsion of claim 1 wherein said gold compound is present in an amount between 0.1 and 50 μmol/mol Ag.

5. The emulsion of claim 1 wherein said gold compound is selected from the group consisting of $AuS_2X$; X=$PR_2$, $CNR_2$, COR, $P(OR)_2$, CR.

6. A method of sensitizing silver halide comprising providing a silver halide grain and bringing said grain into contact with a gold compound represented by Formula I:

$$\{AuS_2X\}_n$$

wherein

X is $PR_2$, $P(OR)_2$, COR, $CNR_2$, CR

R is alkyl or aryl n=1–6.

7. The method of claim 6 wherein said Formula I compound is present in an amount between 0.01 and 100 μmol/mol Ag.

8. The method of claim 6 wherein said compound of Formula I chemically sensitizes said silver halide grain.

9. The method of claim 6 wherein said Formula I compound is present in an amount between 0.1 and 50 μmol/mol Ag.

10. The method of claim 6 wherein X is selected from the group consisting of $PR_2$.

11. The method of claim 6 wherein X is selected from the group consisting of $P(OR)_2$.

12. The method of claim 6 wherein said gold compound comprises $\{AuS_2P(i\text{-}Bu)_2\}_2$.

13. The method of claim 1 wherein said grain is heated while in contact with said gold compound.

14. The method of claim 1 wherein said grain is in a gelatin and water solution when heated.

* * * * *